United States Patent [19]

Johnston et al.

[11] Patent Number: 4,586,676

[45] Date of Patent: May 6, 1986

[54] GARDEN HOSE STORAGE APPARATUS HAVING HOSE GUIDE

[75] Inventors: Damon A. Johnston, Aurora; George L. Garcia, Naperville, both of Ill.

[73] Assignee: Suncast Corporation, Batavia, Ill.

[21] Appl. No.: 611,196

[22] Filed: May 17, 1984

[51] Int. Cl.[4] ..... B65H 75/38

[52] U.S. Cl. ..... 242/86; 242/106; 242/157 R; 137/355.26

[58] Field of Search ..... 242/86, 106, 68.5, 68.6, 242/157 R, 118.1, 118.11, 118.2, 118.3, 118.31, 118.4, 118.7, 76; 254/390, 394–400, 902; 226/196, 199, 190; 474/170, 175, 185, 186, 188, 189, 190; 308/6 R; 137/355.12, 355.16–355.19, 355.26

[56] References Cited

U.S. PATENT DOCUMENTS

| | | | |
|---|---|---|---|
| 1,914,654 | 6/1933 | Tornblom | 242/86 X |
| 2,023,611 | 12/1935 | Neuman | 474/185 |
| 2,283,626 | 5/1942 | Freydberg | 242/68.5 X |
| 2,312,528 | 3/1943 | Davis | 242/86 X |
| 2,659,546 | 11/1953 | Rotter et al. | 242/86 |
| 3,625,450 | 12/1971 | Lloyd, Jr. | 242/86 |
| 3,995,487 | 12/1976 | Locke | 474/186 |
| 4,272,037 | 6/1981 | Becker et al. | 242/118.1 |

*Primary Examiner*—John M. Jillions

*Attorney, Agent, or Firm*—Anthony S. Zummer

[57] ABSTRACT

The instant invention relates to a garden hose storage apparatus having a base and a storage reel rotatably mounted on the base for windably receiving a garden hose. A shelf is secured to the base. The shelf contains an aperture for movably receivng a garden hose. A plurality of rollers is rotatably mounted in the aperture. Said rollers are engageable with the hose to facilitate movement of the garden hose through the aperture for guiding the garden hose on and off the reel.

12 Claims, 6 Drawing Figures

FIG. 5
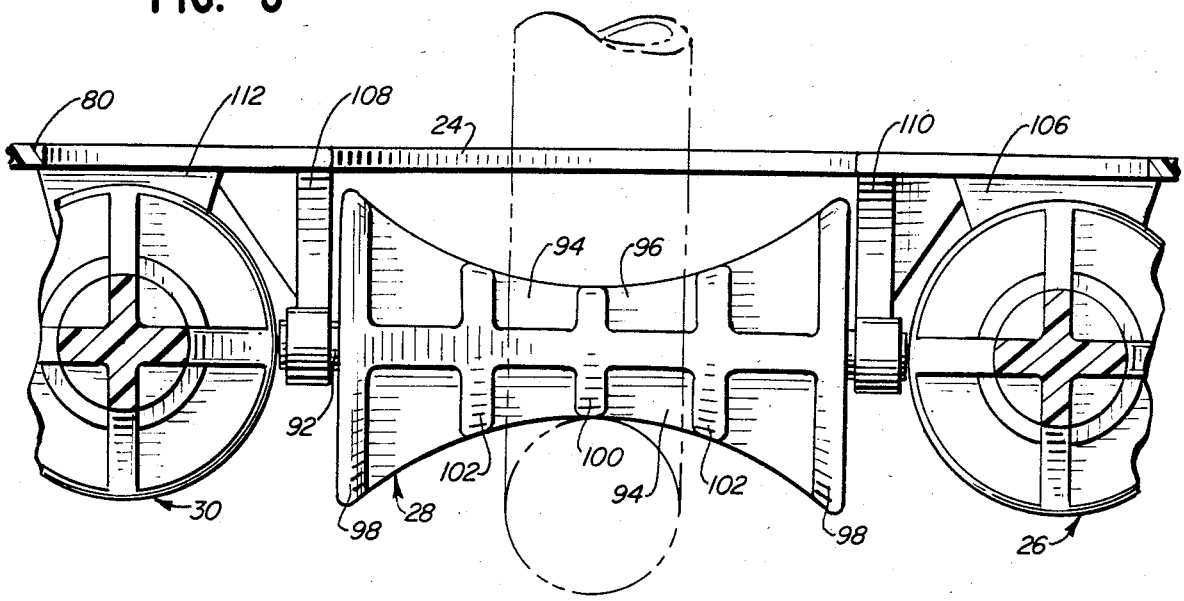
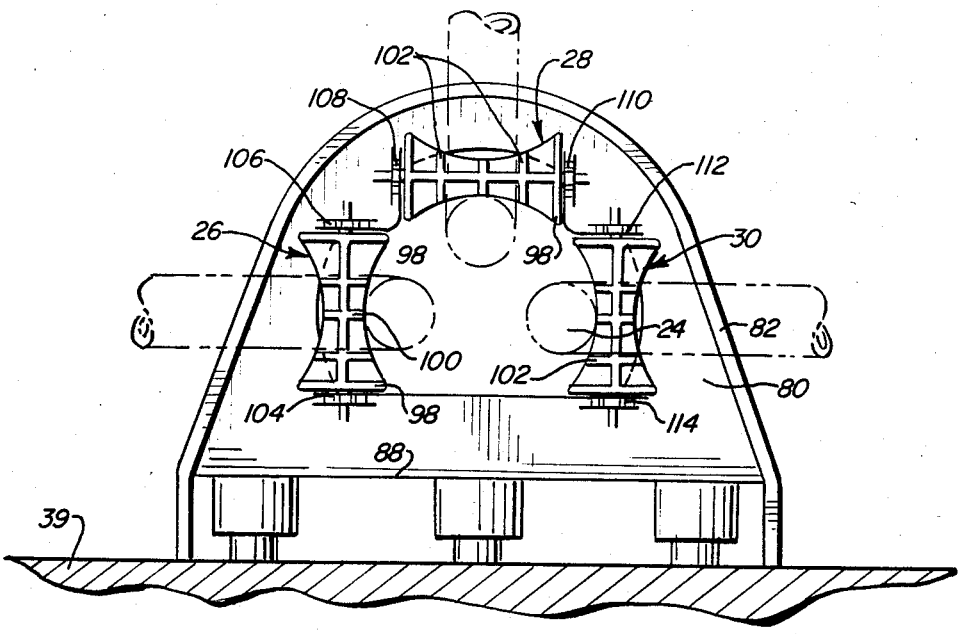
FIG. 6

GARDEN HOSE STORAGE APPARATUS HAVING HOSE GUIDE

BACKGROUND OF THE INVENTION

A garden hose is typically used to supply water to selected locations of a lawn or garden. It is accepted that one convenient method of storing a garden hose be by winding the garden hose onto a reel. It is desirable to guide a garden hose onto a reel so that the hose does not become entangled with a supporting portion on the hose storage apparatus. To this end, it is desirable to provide a guide which directs the garden hose onto the reel. The same guide directs removal of the garden hose from the reel. It may be appreciated that in many instances, the hose is simply pulled to cause the reel to unwind and thereby remove the hose. In the event that the application of a pulling force is to one side of the reel, the hose may be pulled off the reel, and thereby form kinks in the hose. If enough force is applied, the hose may be damaged at a kink.

The utilization of a guide with a garden hose is taught in U.S. Pat. No. 2,805,100, entitled, "Garden Hose Reel Construction", issued Sept. 3, 1957, to L. M. Shaver. The utilization of rollers with a hose is disclosed in U.S. Pat. No. 1,525,837, entitled, "Hose Guide" issued Feb. 10, 1925 to A. C. Walker et al. A hose reel having a guide with a roller is taught in U.S. Pat. No. 238,153, entitled, "Hose Reel", issued Feb. 22, 1881, to H. B. Piper. Rollers having a formed outer surface for engagement with a line are disclosed in U.S. Pat. No. 458,855, entitled, "Hawser-Guide", issued Sept. 1, 1891, to Fred Meinzer. The use of a separate storage area and a separate hose guide is shown in U.S. Pat. No. 2,872,246, entitled, "Hose Reel Mounting", issued Feb. 3, 1959, to F. P. Zierden.

SUMMARY OF THE INVENTION

A garden hose storage apparatus has a base. A reel is rotatably mounted on the base for windably receiving a garden hose thereon. A shelf is connected to the base and is spaced away from the reel. The shelf has an aperture for movably receiving the garden hose. A plurality of rollers is rotatably mounted adjacent to the aperture. The rollers define sides of a hose guide and are rotatably mounted on the shelf. The rollers are rotatably engagable with the hose to facilitate movement of the garden hose through the aperture.

BRIEF DESCRIPTION OF THE DRAWINGS

FIG. 5 is an enlarged cross sectional view taken on Line 5—5 of FIG. 4; and

FIG. 6 is a cross sectional view taken on line 6—6 of FIG. 4.

DESCRIPTION OF THE PREFERRED EMBODIMENT

Figure 1:
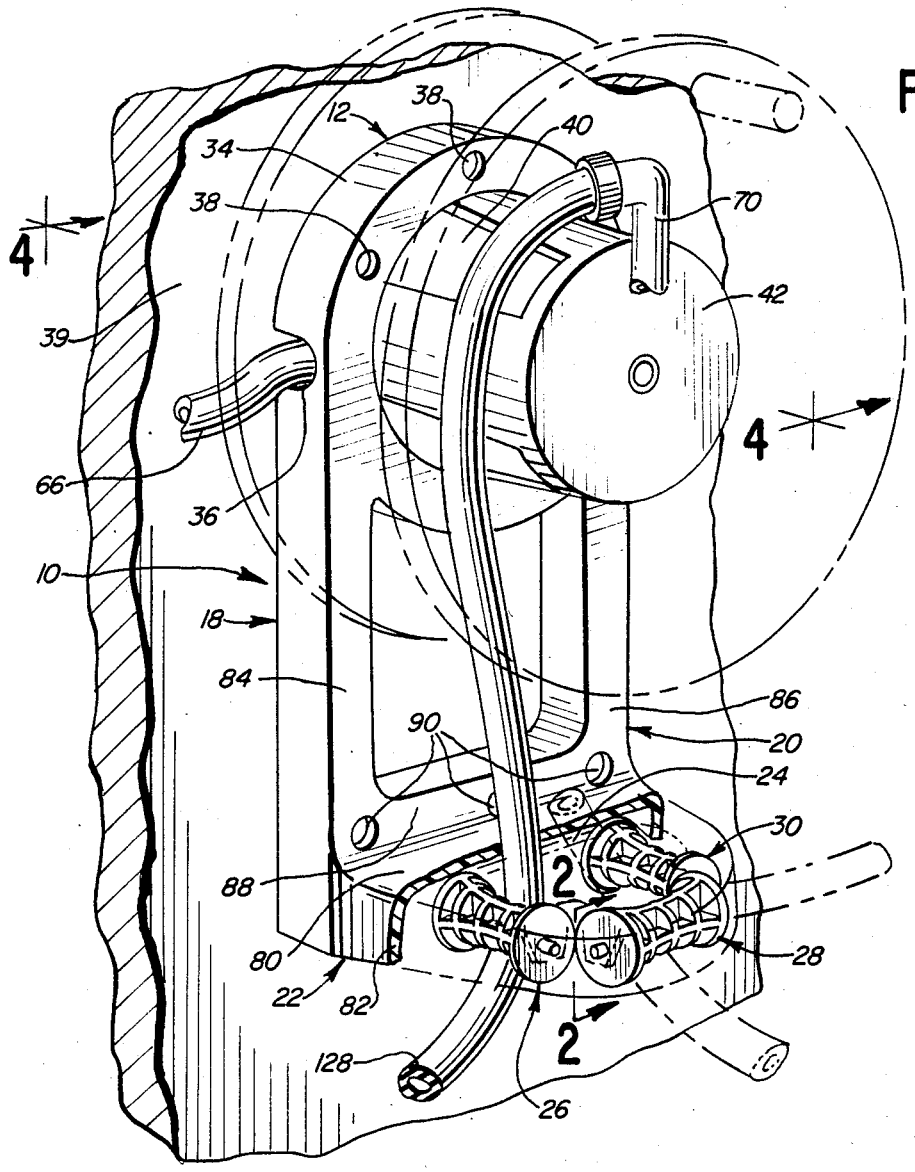
FIG. 1 is a perspective view of a garden hose storage apparatus embodying the present invention with a portion of a shelf shown in phantom view in order to show better the construction of the subject invention.

Referring now to the drawings, a hose storage apparatus generally indicated by numeral 10 is a specific embodiment of the present invention. The hose storage apparatus generally includes a base 12 having a journal 14 formed integral with the base. A reel 16 for windably receiving a garden hose is rotatably mounted on the journal. The details of construction of the reel and the journal are disclosed in copending U.S. patent application Ser. No. 511,569, filed July 7, 1983, now U.S. Pat. No. 4,506,698 entitled, "Garden Hose Storage Apparatus", in which application George L. Garcia, Richard D. Recker, and Thomas A. Tisbo are the inventors. A pair of arms 18 and 20 is formed integral with the base. A shelf 22 is formed integral with the arms and has a hose aperture 24 contained therein. The base, the journal, the arms, and the shelf are a single unitary part which is injection molded of a suitable plastic material for economical production of the part. Three identical rollers 26, 28, and 30 are rotatably mounted adjacent to the aperture for engagement with a garden hose.

Base 12 includes a substantially flat outer wall 32 having a peripheral edge 34. Two hose openings 36 are formed in opposite sides of the peripheral edge. Three identical mounting apertures 38 are formed in the wall to provide a means for receipt of conventional fasteners to secure the base to a mounting surface 39. The mounting surface may be a part of a building wall or other supporting structure.

Journal 14 is tapered with its larger portion adjacent to the base. The journal includes four identical tapered arms 40. Each of the arms has its smaller portion adjacent to the base. An end plate 42 is formed integral with all of the arms. A pipe flange receptacle 44 is formed integral with end plate 42. The pipe flange receptacle includes an outer peripheral wall 46 which defines a flange receiver 48. A conduit aperture 50 is formed in the end plate in the center of the pipe flange receptacle. A receiver recess 52 is formed in the end plate concentric with the center of aperture 50.

Hose reel 16 is a molded unitary plastic part made of polyethylene plastic material, although any other suitable conventional moldable plastic material may be used instead. Hose reel 16 includes a hub 54 which has an interior taper which mates with the exterior taper of journal 14. The hub has a plurality of internal journal bosses 56 which engage the end plate. The reel is rotatably locked to the journal to allow the reel to rotate on the journal. The hub includes an outlet tube aperture 58 adjacent to the outer end of the hub. An inner flange 60 is formed integral with the end of the hub adjacent to the base. An outer flange 62 is formed integral with the other end of hub 54 and includes a handle 64 substantially perpendicular to the remainder of the outer flange.

A conventional hose 66 is positioned in one of the hose openings 36. Hose 66 has a female coupling on one end which is not shown herein, which female coupling is adapted to be attached to a faucet. The other end of hose 66 is connected to an elongated pipe 68. The elongated pipe is rotatably connected to an out tube 70 which is positioned in aperture 58 of the hub. The elongated pipe is made of thermoplastic material, such as, acetal resin, and specifically Delrin 507, manufactured by E. I. Dupont-De-Nemours And Company, of Wilmington, Delaware; however, any other suitable plastic may be used. The elongated pipe is symmetrical about its longitudinal axis. A mounting flange 72 formed integral with the pipe mates with the flange receiver of the pipe flange receptacle in the end plate. A lock cap 74 holds the flange in place to hold pipe 68. A plug 76 closes the end of the pipe so that water, which flows into hose 66, is carried to outlet tube 70. Outlet tube 70 has a threaded connector 78 extending beyond the hub to provide a convenient means for releasably attaching one end of a garden hose to the reel.

Shelf 22 includes a shelf plate 80 and a shelf peripheral edge 82 formed integral with the shelf plate. Arms 18 and 20 contain outer walls 84 and 86, respectively, with edge 34 formed integral with the outer walls. A connector plate 88 is formed integral with the arms. Connector plate 88 includes three mounting apertures 90 which provide a means for receiving fasteners for securing the connector plate to the mounting surface 39.

Rollers 26, 28, and 30 form three contiguous sides positioned adjacent to hose aperture 24. The rollers form a portion of a circle greater than a semicircle which is a roller guide. The rollers are positioned below shelf plate 80 and are substantially aligned with hose aperture 24 in the shelf plate. Thus, a garden hose may pass through aperture 24 and into engagement with one of the rollers of the roller guide. The longitudinal axis of roller 26 is parallel to that of roller 30. Roller 28 has its longitudinal axis perpendicular to the axes of roller 26 and 30.

Figure 2:
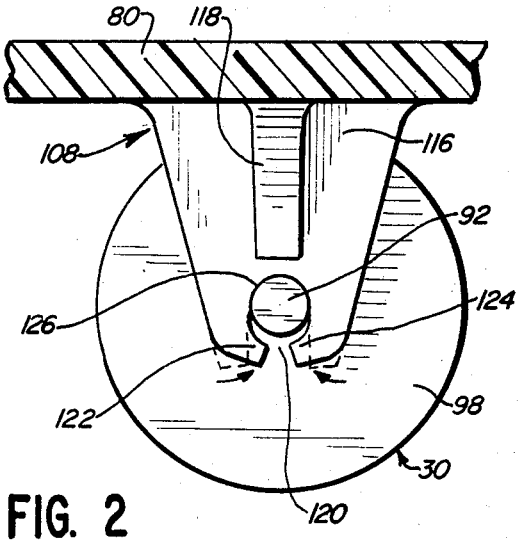
FIG. 2 is an enlarged cross sectional view taken on Line 2—2 of FIG. 1.
Figure 3:
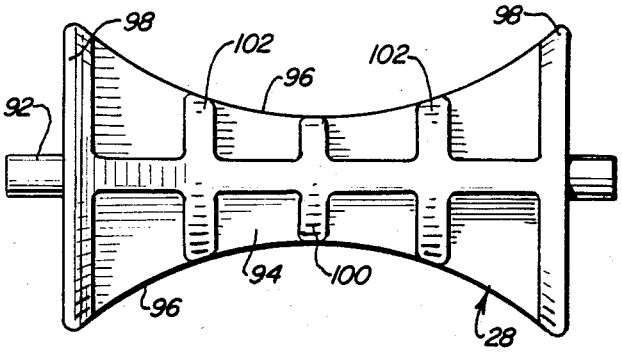
FIG. 3 is an enlarged elevational view of one of the rollers of FIG. 1.
Figure 4:
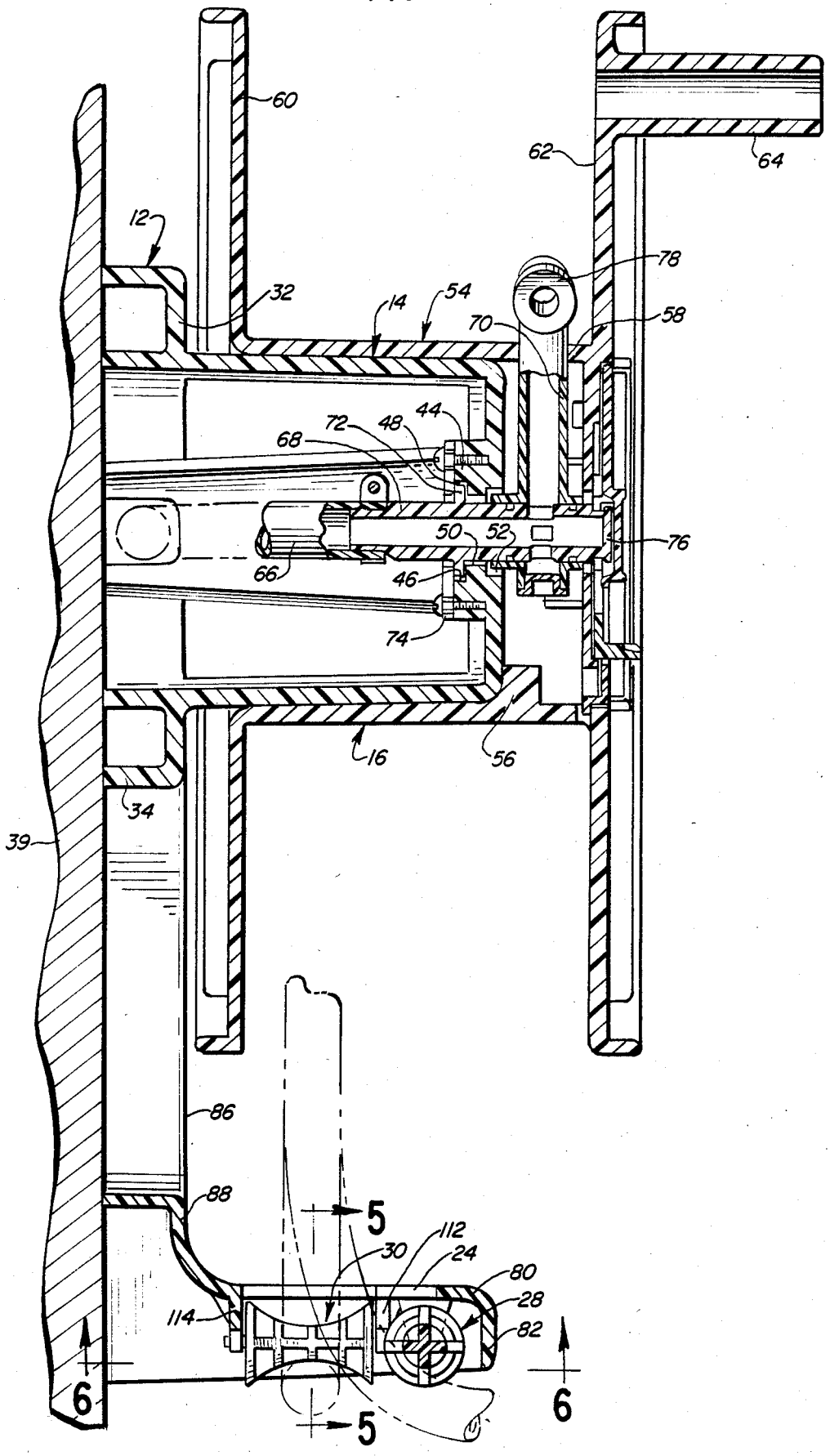
FIG. 4 is an enlarged cross sectional view taken on Line 4—4 of FIG. 1.

The rollers are identical in construction to each other. Each of the rollers includes an elongated axle 92 which has four identical roller plates 94 integrally formed thereon. Plates 94 are spaced 90° apart from each other and are aligned with the longitudinal axis of axle 92. Each plate 94 has an outer edge 96 which forms part of a circle which is intermittently a part of the portion of the circle of the roller guide. An end reinforcement web 98 is formed integral with each end of each of the roller plates 94 and is adjacent to the ends of axle 92. The reinforcement webs are circular as may be seen in FIG. 2. A middle reinforcement web 100 is formed integral with the axle and the roller plates midway between end reinforcement webs 98. The middle reinforcement web also has a circular outer periphery which has its center on the longitudinal axis and its outer periphery on the outer edges of the roller plates. A pair of intermediate reinforcement webs 102 is formed integral with axle 92 and plates 94. The intermediate reinforcement webs are positioned midway between their respective end reinforcement webs 98 and middle reinforcement web 100. The intermediate reinforcement webs are also circular. The intermediate reinforcement webs also have their center on the longitudinal axis of the axle and have their outer periphery in the outer edges of the roller plates. All of the webs 98, 100 and 102 are parallel to each other and are perpendicular to the longitudinal axis of axle 92. Each of the rollers is a unitary molded part which may be molded by a conventional injection molding operation.

Each of the rollers is rotatably supported on a pair of identical ears. Roller 26 is rotatably supported on a pair of ears 104 and 106. Roller 28 is rotatably supported on a pair of ears 108 and 110. Roller 30 is rotatably supported on ears 112 and 114. All of the ears are formed integral with the side of shelf plate 80 spaced away from reel 16.

All of the ears are identical in construction to the other ears. Ear 108 is shown in detail in FIG. 2. Ear 108 includes a bracket 116 which is generally triangular in shape and has one side formed integral with the shelf plate. A triangular brace 118 has one side formed integral with shelf plate 80 and another side with bracket 116. The bracket includes a slot 120 in its free apex. The bracket has a pair of tabs 122 and 124 on opposite sides of the slot. When the ear is originally formed, the slot 120 has a width slightly greater than the diameter of axle 92 of each of the rollers. The slot has a rounded end 126 which receives the axle 92. In the assembly of each roller in its respective ears, the roller has the ends of its axle positioned in the respective slots 120, and the ears are staked. Tabs 122 and 124 are simultaneously heated and a force is applied to the tabs to force the tabs toward each other to reduce the width of slot 120 and thereby lock the axle into rotatable connection with the ear.

In the operation of the instant device, the hose reel storage apparatus is mounted on mounting or support surface 39. Hose 66 is connected to a source of water. A conventional garden hose 128 is threadedly connected to outlet tube or pipe 70. When it is necessary to wind the garden hose onto the reel, handle 64 is rotated to wind the hose onto the reel as the reel rotates. As the hose is wound onto the reel, the hose engages at least one of the three rollers so that the hose is smoothly wound onto the reel. It may be appreciated that inasmuch as the rollers have the plates having the curved outer surface, the rollers provide a guide aperture which is generally circular so that when the hose is wound onto the reel from any direction but that of the supporting surface, the hose contacts a roller. As the hose is wound onto the reel, there is assurance that the hose is always directed between flanges 60 and 62, so that it does not become wound on the supporting structure for the reel.

When it is necessary to remove the hose, the hose is pulled off the reel. The hose is always removed between the flanges since the guide aperature is positioned in line with a portion of the reel between the flanges. It follows that the hose is not pulled off to one side of the reel to pull the hose over a flange and thereby cause a crimp in the hose or become entangled in the supporting structure of the hose. Although the hose may be pulled in a direction which is substantially parallel to the axis of rotation of the reel, the hose still unwinds smoothly since the hose engages roller 30 and rolls with the roller. The same is true when the hose is wound back onto the reel. Even though the hose may be lying parallel to the direction of rotation of the axis of rotation, the hose is delivered to the reel between the flanges, and it may be wound smoothly onto the reel.

Although a specific embodiment of the present invention has been shown and described in detail above, it is readily apparent that those skilled in the art may make various modifications and changes without departing from the spirit and scope of the present invention. It is to be expressly understood that the instant invention is limited only by the appended claims.

We claim:

1. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, a shelf support having one end formed integral with the base and the other end formed integral with the shelf, and said base, said journal, said shelf support, and said shelf being a single molded unitary plastic part.

2. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, and a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, each of the rollers includes; an axle, a plurality of substantially flat walls formed integral with the axle, said walls aligned with the axle, each of said flat walls having its outer surface having a greater distance at the ends of the wall to the axle than at the center of the respective wall, and a plurality of webs formed integral with the walls, each of said webs being substantially perpendicular to the axle.

3. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, a shelf support having one end formed integral with the base and the other end formed integral with the shelf; said base, said journal, said shelf support, and said shelf being a single molded unitary plastic part; and each of the roller being rotatably supported by a pair of spaced ears; each of the ears having one end formed integral with the shelf and being a portion of the single molded unitary plastic part; said ears being positioned on the side of the shelf away from the reel, whereby the axis of rotation of each of the rollers is adjacent to the side of the shelf away from the reel.

4. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, a pair of spaced ears rotatably supporting each of the rollers, each of the ears having one end formed integral with the shelf, said ears being positioned on the side of the shelf away from the reel; each of the rollers including; an axle, a plurality of flat walls formed integral with the axle aligned with the axle, each of said flat walls having its outer surface having a greater distance at the end of the wall adajcent to the respective end of the axle than at the center of the wall; and a plurality of webs formed integral with the walls, each of said webs being substantially perpendicular to the axle.

5. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, a shelf support having one end formed integral with the base and the other end formed integral with the shelf; said base, said journal, said shelf support, and said shelf being a single molded unitary plastic part; and each of the rollers includes; an axle, a plurality of substantially flat walls formed integral with the axle, said walls aligned with the axle, each of said flat walls having its outer surface having a greater distance at each of the ends of the wall to the axle than at the center of the wall, and a plurality of webs formed integral with the walls and the axle, each of said webs being substantially perpendicular to the walls and to the axle, each of said rollers being a molded plastic unitary part.

6. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, a shelf support having one end formed integral with the base and the other end formed integral with the shelf; said base, said journal, said shelf support, and said shelf being a single molded unitary plastic part; and said plurality of rollers including; a pair of rollers parallel to each other and a third roller having its axis substantially perpendicular to the axes of the other two rollers, said rollers defining three sides of the hose guide and being engageable with the garden hose.

7. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, said plurality of rollers includes; a pair of rollers parallel to each other and a third roller having its axis substantially perpendicular to the axes of the other two rollers; each of said rollers including; an axle, a plurality of substantially flat walls formed integral with the axle aligned with the axle, each of said flat walls having its outer surface having a greater distance at the ends of the wall to the axle than the distance at the center of the wall to the axle, and a plurality of webs formed integral with the walls, each of said webs being substantially perpendicular to the axle, and each of said rollers being a unitary integral plastic part.

8. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, a shelf support having one end formed integral with the base and the other end formed integral with the shelf; said base, said journal, said shelf support, and said shelf being a single molded unitary plastic part; a pair of spaced ears rotatably supporting each of the rollers, each of the ears having one end formed integral with the shelf and being a portion of the molded unitary plastic part, said ears being positioned on the side of the shelf away from the reel; the axis of rotation of each of the rollers being adjacent to each side of the shelf away from the reel; each of the rollers including; an axle, a plurality of substantially flat walls formed integral with the axle, said flat walls being aligned with the axle, each of said flat walls having its outer surface having a greater distance at the ends of the walls to the axle than at the center to the respective wall to the axle, and a plurality of webs formed integral with the walls, each of the webs being substantially perpendicular to the axle and to the walls, and each of said rollers being a single unitary molded roller part.

9. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, said plurality of rollers includes; a pair of rollers having their axes parallel to each other, and a third roller having its axis substantially perpendicular to the axes of the other two rollers, said rollers defining three sides of the hose guide and being engageable with the garden hose; each of the rollers supported by a pair of spaced ears, each of the ears having one end formed integral with the shelf, said ears being positioned on the side of the shelf away from the reel, whereby the axis of rotation of each of the rollers is adjacent to the side of the shelf away from the reel; and each of the rollers includes; an axle, a plurality of substantially flat walls formed integral with the axle, said flat walls aligned with the axle, each of said flat walls having its outer surface having a greater distance at the ends of the wall to the axle than at the center to the axle, and a plurality of webs formed integral with the walls, each of said webs being substantially perpendicular to the axle, and each of said rollers being a single molded unitary plastic part.

10. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, a shelf support having one end formed integral with the base and the other end formed integral with the shelf; said base, said journal, said shelf support, and said shelf being a single molded unitary plastic part; said plurality of rollers including, a pair of rollers having their longitudinal axes parallel to each other and a third roller having its axis substantially perpendicular to the axes of the other two rollers, said rollers defining three sides of the hose guide and being engageable with the garden hose; and each of the rollers including; an axle, a plurality of substantially flat walls formed integral with each axle, said flat walls aligned with the axle, each of said flat walls having its outer surface having a greater distance at the ends of the wall to the axle than at the center of the wall, a plurality of webs formed integral with the walls, each of said webs being substantially perpendicular to the axle, and each of said rollers being a molded unitary plastic part.

11. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, a pair of spaced ears rotatably supporting each of the rollers, each of the ears having one end formed integral with the shelf, said ears being positioned on the side of the shelf away from the reel, whereby the axis of rotation of each of the rollers is adjacent to the side of the shelf away from the reel; a shelf support having one end formed integral with the base and the other formed integral with the shelf; said base, said journal said shelf support, and said shelf being a single molded unitary plastic part; said plurality of rollers including; a pair of rollers having their longitudinal axes parallel to each other and a third roller having its axis substantially perpendicular to the axes of the other two rollers, said rollers defining three sides of the hose guide and being engageable with the garden hose; each of the rollers including; an axle, a plurality of substantially flat walls formed integral with the axle, said flat walls aligned with the axle, each of said flat walls having its outer surface having a greater distance at the ends of the wall to the axle than at the center of the respective wall, a plurality of webs formed integral with the walls, each of said webs being substantially perpendicular to the axle, and each of said rollers being a single molded unitary part.

12. A garden hose storage apparatus having a base, a journal supported by the base, and a reel rotatably mounted on the journal for windably receiving a garden hose thereon, the improvement comprising; a shelf secured to the base and being spaced from the reel, said shelf having an aperture for receiving a garden hose windably mountable on the reel, a plurality of rollers rotatably mounted on the shelf and being positioned adjacent to the aperture defining a plurality of contiguous sides of a hose guide, said rollers being rotatably engageable with the hose received in the aperture to facilitate movement of the garden hose through said aperture, said plurality of rollers includes; a pair of elongated rollers having their respective axes of rotation parallel to each other and a third roller positioned between the ends of the pair of rollers and having its axis of rotation substantially perpendicular to the axes of rotation of the other two rollers, said rollers defining three contiguous sides of the hose guide and being engageable with the garden hose; including; a pair of spaced ears rotatably supporting each of the rollers, each of the ears having one end formed integral with the shelf, each of said ears having a slot in its free end for receiving a portion of its respective roller, said ears being positioned on the side of the shelf away from the reel, whereby the axis of rotation of each of the rollers is adjacent to the side of the shelf away from the reel; a shelf support having one end formed integral with the base and the other end formed integral with the shelf; said base, said journal, said shelf support, said shelf, and said ears being a single molded unitary plastic part; each of the rollers including; an axle having its opposite ends positioned in a slot in a respective ear, substantially flat walls formed integral with the axle, each of said flat walls aligned with the axle, said substantially flat walls being spaced apart approximately 90° about the axle, each of said flat walls having its outer surface having a greater distance at the ends of the wall to the axle than at the center of the respective wall, and a plurality of webs formed integral with the walls and with the axle, each of said webs being substantially perpendicular to the axle and to the walls, each of said rollers being a molded plastic unitary part; and said ears having their free ends staked to hold rotatably their respective axles of the rollers in the slots.

* * * * *

UNITED STATES PATENT AND TRADEMARK OFFICE

CERTIFICATE OF CORRECTION

PATENT NO. : 4,586,676

DATED : May 6, 1986

INVENTOR(S) : Damon A. Johnston and George L. Garcia

It is certified that error appears in the above-identified patent and that said Letters Patent are hereby corrected as shown below:

Claim 11, Col. 8, Line 53; after "other" insert --end--

Signed and Sealed this

*Fifth* Day of *August 1986*

[SEAL]

*Attest:*

DONALD J. QUIGG

*Attesting Officer*

*Commissioner of Patents and Trademarks*